US008001692B2

(12) United States Patent
Han et al.

(10) Patent No.: US 8,001,692 B2
(45) Date of Patent: Aug. 23, 2011

(54) NAIL CLIPPER

(76) Inventors: Jeong Sik Han, Seoul (KR); Gyoung Hee Kim, Seoul (KR)

( * ) Notice: Subject to any disclaimer, the term of this patent is extended or adjusted under 35 U.S.C. 154(b) by 178 days.

(21) Appl. No.: 12/087,751

(22) PCT Filed: Jul. 31, 2007

(86) PCT No.: PCT/KR2007/003668

§ 371 (c)(1),
(2), (4) Date: Jul. 14, 2008

(87) PCT Pub. No.: WO2008/026832

PCT Pub. Date: Mar. 6, 2008

(65) Prior Publication Data

US 2008/0313908 A1 Dec. 25, 2008

(30) Foreign Application Priority Data

Aug. 29, 2006 (KR) ..... 10-2006-0082020
Jun. 5, 2007 (KR) ..... 10-2007-0054955

(51) Int. Cl.
*A45D 29/02* (2006.01)

(52) U.S. Cl. ..... 30/28; 30/124; 132/75.5

(58) Field of Classification Search ..... 30/28, 29, 30/124; 132/75.5; D28/60; D7/653
See application file for complete search history.

(56) References Cited

U.S. PATENT DOCUMENTS

D85,232 S * 9/1931 Farquharson ..... D7/653
1,849,592 A 3/1932 Schnefel
2,179,435 A * 11/1939 Smith ..... 30/28
D167,088 S * 6/1952 Laughlin ..... D7/691
D176,160 S * 11/1955 Seibert et al. ..... D7/653
2,774,138 A * 12/1956 Gowdey ..... 30/28
3,169,312 A * 2/1965 Fink ..... 30/28
D204,075 S * 3/1966 Laughlin ..... D7/663
3,744,131 A * 7/1973 Manes ..... 30/28
4,073,670 A 2/1978 Mitra
4,130,937 A * 12/1978 Kim ..... 30/28
4,380,120 A * 4/1983 Hannon ..... 30/28
4,574,475 A 3/1986 Lee
4,614,031 A * 9/1986 Chen ..... 30/28
4,640,011 A * 2/1987 Gamble ..... 30/28

(Continued)

FOREIGN PATENT DOCUMENTS

JP 46-009067 3/1971

(Continued)

OTHER PUBLICATIONS

International Search Report Application No. PCT/KR2007/003668, dated Oct. 12, 2007.

(Continued)

*Primary Examiner* — Hwei-Siu C Payer
(74) *Attorney, Agent, or Firm* — Buchanan Ingersoll & Rooney PC

(57) ABSTRACT

Embodiments of the invention provide a nail clipper. The nail clipper comprises upper and lower blade members with a suitable length to hold by hand which face each other and form inner concave parts of the spoon shape; cutting blades that face each other at one end of the concave part; support shaft holes to the cutting blades; elastic parts extended to one side of each of the concave parts, which are joined at the end to consolidate the upper and lower blade members; and a lever located above the upper blade member and connected through upper and lower blade members via the supporting shaft.

10 Claims, 7 Drawing Sheets

U.S. PATENT DOCUMENTS

| | | | | | |
|---|---|---|---|---|---|
| 4,731,927 | A | | 3/1988 | Wilson | |
| 4,776,090 | A | * | 10/1988 | Grassi | 30/28 |
| 4,809,431 | A | * | 3/1989 | Idema | 30/28 |
| 5,010,644 | A | * | 4/1991 | Goench | 30/28 |
| 5,063,666 | A | * | 11/1991 | Tsay | 30/28 |
| 5,072,511 | A | | 12/1991 | Ro | |
| 5,273,954 | A | | 12/1993 | Takano et al. | |
| 5,522,136 | A | * | 6/1996 | Larisey | 30/28 |
| D371,636 | S | | 7/1996 | O'Neal | |
| 5,537,747 | A | * | 7/1996 | Cacciotti et al. | 30/28 |
| 5,653,024 | A | * | 8/1997 | Cartagenova | 30/28 |
| 5,832,610 | A | | 11/1998 | Chaplick | |
| 5,881,461 | A | * | 3/1999 | Schwartz | 30/28 |
| 5,983,498 | A | | 11/1999 | Lieberman et al. | |
| D486,943 | S | * | 2/2004 | Kim | D28/60 |
| 6,702,820 | B2 | * | 3/2004 | Mazur | 606/83 |
| 2008/0060200 | A1 | * | 3/2008 | Cha | 30/28 |

FOREIGN PATENT DOCUMENTS

| | | |
|---|---|---|
| JP | 48-020683 | 3/1973 |
| JP | 48-029681 | 4/1973 |
| JP | 48-083176 | 11/1973 |
| JP | 49-008181 | 1/1974 |
| JP | 49-120419 | 11/1974 |
| JP | 51-119970 | 10/1976 |
| JP | 52-066577 | 6/1977 |
| JP | 54-098369 | 8/1979 |
| JP | 54-116468 | 9/1979 |
| JP | 57-027204 | 2/1982 |
| JP | 57-176804 | 10/1982 |
| JP | 01-145305 | 6/1989 |
| JP | 10-085032 | 4/1998 |
| JP | 10-276833 | 10/1998 |
| JP | 2004-313614 | 11/2004 |
| JP | 2005-007119 | 1/2005 |
| JP | 2005-074135 | 3/2005 |
| KR | 20-0255093 | 11/2001 |
| KR | 10-0342974 | 6/2002 |
| KR | 20-0335633 | 12/2003 |

OTHER PUBLICATIONS

International Search Report Application No. PCT/KR2007/000184, dated Apr. 13, 2007.

Han et al., U.S. Appl. No. 12/087,752, entitled "Manufacturing Method for Arc Type Nail Clipper Blade, and its Nail Clipper Blade and its Nail Clipper", filed Jul. 14, 2008.

* cited by examiner

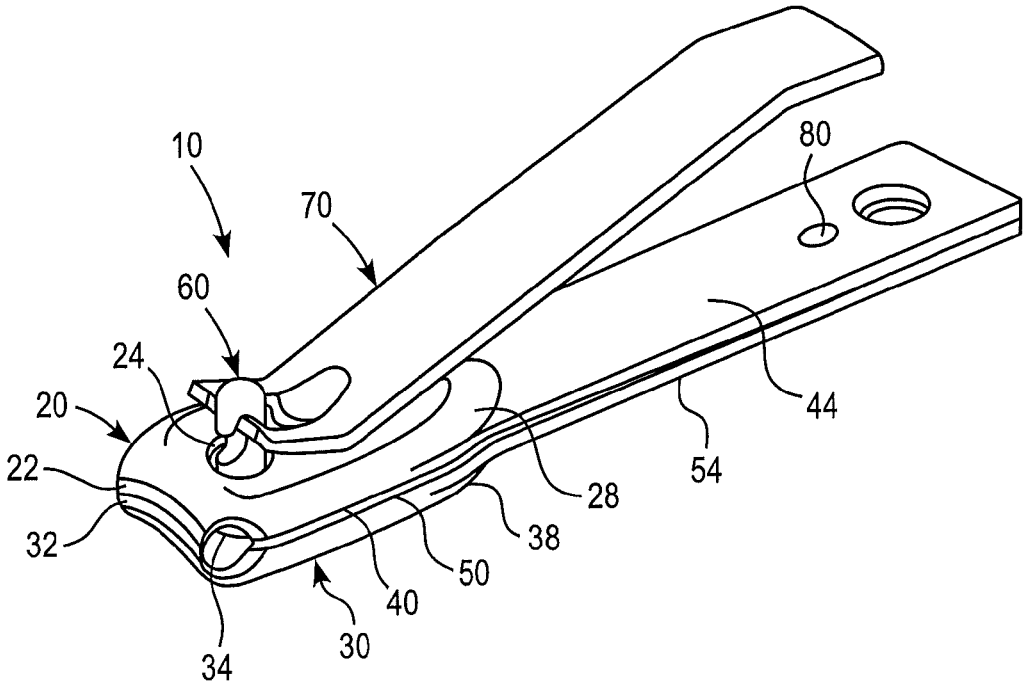
FIG. 3B
FIG. 4
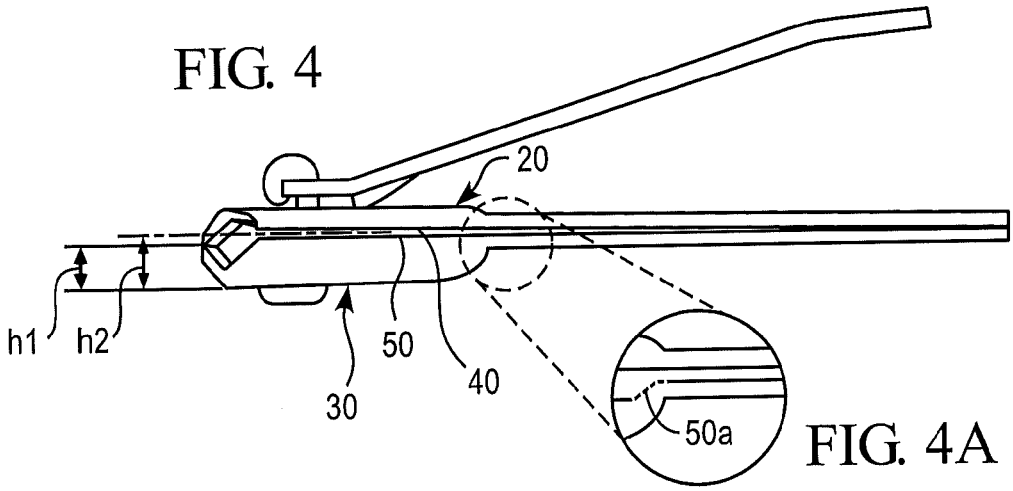
FIG. 4A

NAIL CLIPPER

TECHNICAL FIELD

The present invention relates to nail clippers for cutting fingernails and toenails, more particularly, to a nail clipper having upper and lower blade members which face each other and form inner concave parts of the spoon shape, which is capable of preventing scattering and facilitates the collection of cut nails because upper and lower concave parts of the nail clipper are closed when the nail is cut.

Further, the present invention provides with nail clippers having a concave part of a curved surface like an inner surface of the spoon continued to a cutting blade on one side of each of upper and lower blade members that cold plastic working may be useful. Moreover, from the mechanical point of view, this concave part forms a dome convex shape when viewed from the outside, so that the lever can evenly distribute the stress on the upper blade member to all directions. As a result, it may achieve a nail clipper capable of using a thin material and providing with more flexible elasticity at the other portions outside off it than the concave part.

BACKGROUND ART

The conventional nail clippers are composed of cutting blades with a suitable length to hold by hand which face each other at one side of upper and lower blade members in one end of a plane metal board, wherein other side is jointed by spot welding; a supporting shaft hole adjacent to the cutting blades; and a lever located above the upper blade member and connected through upper and lower blade members via a supporting shaft.

In this case, since the cutting blades to clip the nail are composed of 35~45 degrees wedge, the clipped nail fragments are usually scattered when the nails are cut.

In consideration of such a problem, many techniques with respect to a nail clipper having a separate cover has been developed and commercialized.

The conventional art that includes a scatter prevention wall formed integrally with a blade instead of a separate cover has been disclosed in Korean Utility Model No. 255093 issued on Nov. 12, 2001 and Japanese Utility Model Pub. No. So 57-176804 and the scatter prevention wall therein is formed by blocking the side after extending one side of upper and lower blade members and perpendicular bending so as to prevent the scattering of the clipped nails to all direction when the user clips nails.

Korean Utility Model No. 335633 and Japanese Utility Model Laid-Open Pub. No. So 48-029681, So 48-083176, So 48-020683, So 57-027204, So 46-009067, Korean Patent No. 342974 and U.S. Pat. Nos. 1,849,592, 4,731,927 and 5,072,511 have disclosed a scatter preventing wall which is integrally formed with sides of upper and a lower blade members so as to prevent scattering the nail fragments.

In case of such a scatter preventing wall which is integrally formed to the upper and lower blade members, since both sides of the upper and lower blade members are extended in order to form the scatter preventing wall, an additional material cost may be incurred as much as the extension thereof.

The nail clipper may be made of materials with a high hardness so that the durability of a cutting blade can be maintained. Further, the metal materials of the upper and lower blade members should have a soft resilient so that cutting blades may be engaged each other or may be open, and may be used without effort. However, the flexibility is highly decreased because the rigidity becomes high as the properties of material have a high hardness. An existing heating stainless material of a high hardness is usual to be open an end of a bending part when perpendicularly bending.

Further, a member which is perpendicularly bent hardly has any elasticity. In case that a scatter prevention wall reaches a middle part in cutting blades length, a rear part is opened, thereby the clipped nail fragments are dispersed. Otherwise, in case that a scatter prevention wall reaches a contact part of cutting blades, the elasticity in the cutting blades is gone. Accordingly, due to these practical problems in manufacture and use, it is difficult to find their commercialized products up to now even though more than 40 years has passed after the conventional arts are publicly known.

DISCLOSURE OF INVENTION

It is therefore an object of the present invention to overcome the foregoing and other problems encountered in connection with the conventional art, and to provide a nail clipper which prevents scattering and facilitates the collection of the clipped nails when the nails are cut. Instead of extending both sides with upper and lower blade members and forming a scatter prevention wall by a separate perpendicular bending, this invention forms a concave part, like a spoon. One side forms a cutting blade and the other side an elastic part that also plays the role of a handle, featuring a joint or combination of the top and bottom members of which the concave parts face each other. When a nail is cut, the top and bottom concave members are closed to block the scattering fingernails and play the role of a container for temporarily storing the cut nails.

Another object of the present invention is to reduce manufacturing cost by improving the strength of the concave parts of upper and lower blade members and decrease the thickness of the material.

The upper concave part may be more naturally formed than a perpendicular bending in cold plastic working by pressing process. Moreover, from the mechanical point of view, this concave part forms a dome convex shape when viewed from the outside, so that the lever may evenly distribute the stress on the upper blade member to all directions. As a result, this has much better durability against stress than the scatter prevention wall of which both sides are perpendicularly bent.

Likewise, the concave part of the lower blade member forms a convex shape when viewed from the outside, and can evenly distribute the stress by the flange of the supporting shaft to all directions like a dome. Thus, it has much better durability against stress than the scatter prevention wall that is perpendicularly bent.

For the durability against the pressing operation by the lever from the upper blade member of the nail clipper, the thickness of the metal plate can be decreased more than that of existing nail clippers. An additional object of this invention is to provide more flexible elasticity. The extension of the sides of upper and lower blade members and the perpendicularly bent scatter prevention wall form a perpendicular bending close to the joint between the upper and lower blade members so as to remove the gap between upper and lower blade members. This makes a rigid part, and significantly decreases the area to be used for elasticity and makes it difficult to create soft elasticity. It also concentrates stress in a narrow area, making it easy to be broken.

However, the concave part of this invention for prevention of scattering nails has flexible elasticity because it is limited to a part adjacent to the cutting blade and the remaining part consists of an elastic part and a joint.

The nail clipper part of this invention comprise upper and lower blade members which face each other and form inner concave parts of the spoon shape; cutting blades that face each other at one end of the concave part; support shaft holes to the cutting blades; elastic parts extended to one side of the above concave parts, which are joined at the end to consolidate the upper and lower blade members; and a lever located above the upper blade member and connected through upper and lower blade members via the supporting shaft. The upper and lower concave parts are closed when the nail is cut to intercept scattering nails and store them temporarily, playing the role of a nail collecting container.

One feature of this invention is a concave part formed on any of the upper and lower blade members mentioned above.

Another feature of this invention is the shape of the cutting blades formed on the upper and lower blade members, which cuts nails in a convex curve or straight line, in an arch shape in accordance with the sectional shape of the nail, in a shape slanted to one side, or in a shape that is slanted to one side and pointed.

Yet another feature of this invention is the rims of the concave parts formed on the upper and lower blade members which are on the same plane as the elastic part extended from them without any difference of height.

However, a little transformation is possible due to problems of design or production technology, so that the rim of any of the upper and lower blade members is extended to the rim of the other member so they are overlapped, or the contacting of the rims of upper and lower concave parts is leaning to one side. Still another feature of this invention is the prevention of nail scattering by varying the height of the contact between upper and lower blade members and the height of the contact of rims of the concave parts. Still yet another feature of this invention is that the cutting blades of upper and lower blade members are engaged with each other and the rims of the concave parts do not contact closely but maintain a close gap with the other blade member when the nail is cut.

Therefore, the example in this specification and the construction illustrated on the drawings is only one desirable example of this invention and does not represent all the technical ideas of this invention. There can be various equivalents and variations of this invention at the time of this application.

DESCRIPTION OF DRAWINGS

The accompanying drawings illustrate example embodiments of the present invention. Example embodiments may, however, be embodied in different forms and should not be construed as limited to the embodiments set forth in the drawings. Rather, these embodiments are provided so that this disclosure will be thorough and complete, and will fully convey the scope of the invention to those skilled in the art.

FIGS. 3A and 3B are views illustrating an operation state of a nail clipper according to an example embodiment of the present invention;

FIG. 4 is a side view illustrating a nail clipper where the heights of the contact between the rim of the upper and lower blade members are crossed each other according to a modified example embodiment of FIG. 1. FIG. 4A is a magnified view of an area of FIG. 4 illustrating deflection in the height of the rim of the upper or lower blade member;

FIG. 7 is a view illustrating a nail clipper where cutting blades are of a straight shape;

FIG. 8 is a view illustrating a nail clipper where cutting blades are of an arc shape corresponding to the sectional view of the nail;

FIG. 9 is a view illustrating a nail clipper where the shape of cutting blades is leaned toward one side; and FIG. 10 is a perspective view illustrating the nail clipper where the shape of cutting blades is leaned toward one side and pointed.

BEST MODE

Preferred exemplary embodiments of the present invention will now be described in greater detail with reference to the accompanying drawings.

Figure 1:
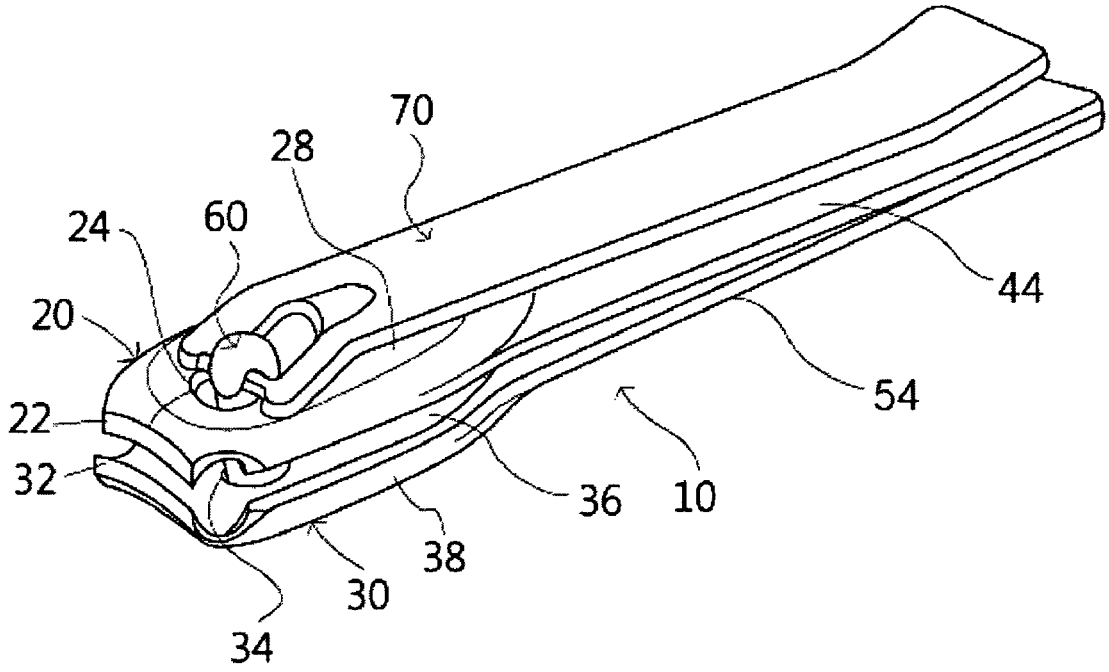
FIG. 1 is a perspective view of a nail clipper according to an example embodiment of the present invention.
Figure 2:
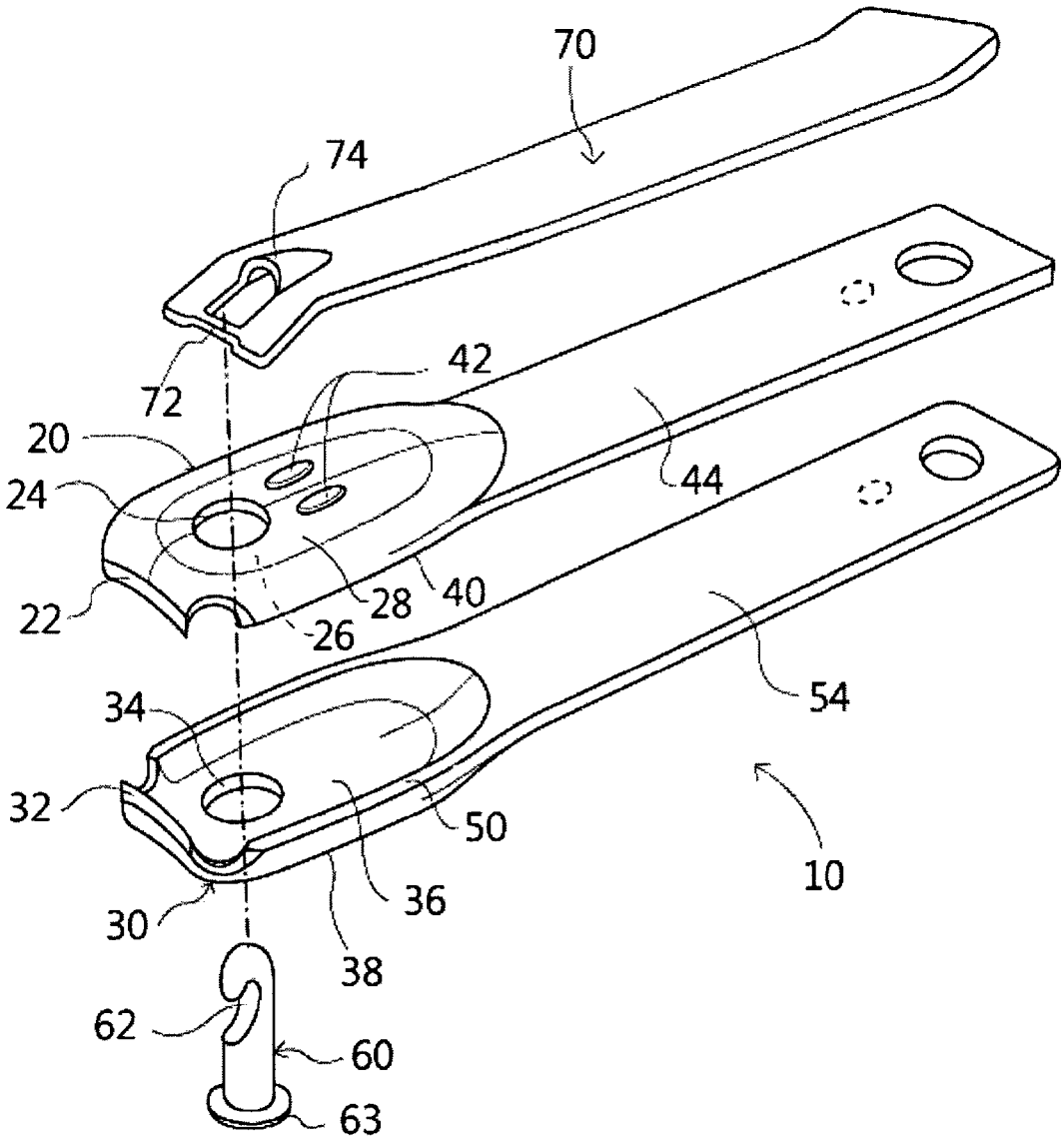
FIG. 2 is a separated perspective view of the nail clipper as shown in FIG. 1.

FIG. 1 is a perspective view of a nail clipper according to an example embodiment of the present invention and FIG. 2 is a separated perspective view of the nail clipper as shown in FIG. 1.

A reference numeral 10 in the drawings is an overall view of the nail clipper of this invention, which largely comprises an upper blade member 20, a lower blade member 30, a supporting shaft 60, and a lever 70.

The upper blade member 20 and the lower blade member 30 have a length appropriate for holding with one hand, and face each other forming inner concave parts 26, 36 of the spoon shape. There are cutting blades that face each other at one side of the concave parts 26, 36, which are extended from the concave parts 26, 36. There are support shaft holes 24, 34 on the concave parts 26, 36 adjacent to the cutting blades 22, 32. At one side of the concave parts 26, 36, there are elastic parts 44, 54 which play the role of a flat handle. The elastic parts 44, 54 are spot welded 80 at one side in such a way that the concave parts 26, 36 face inside, forming a pair of upper blade members 20 and lower blade members 30. The supporting shaft, which passes through the support shaft hole 34 of the lower blade member 30 and is caught by the flange 63 of the supporting shaft 60 and passes through the support shaft hole 24 of the upper blade member 20, is combined with the lever 70 which applies leverage, and is located at the convex part 28 of the upper blade member 20.

Figure 3A:
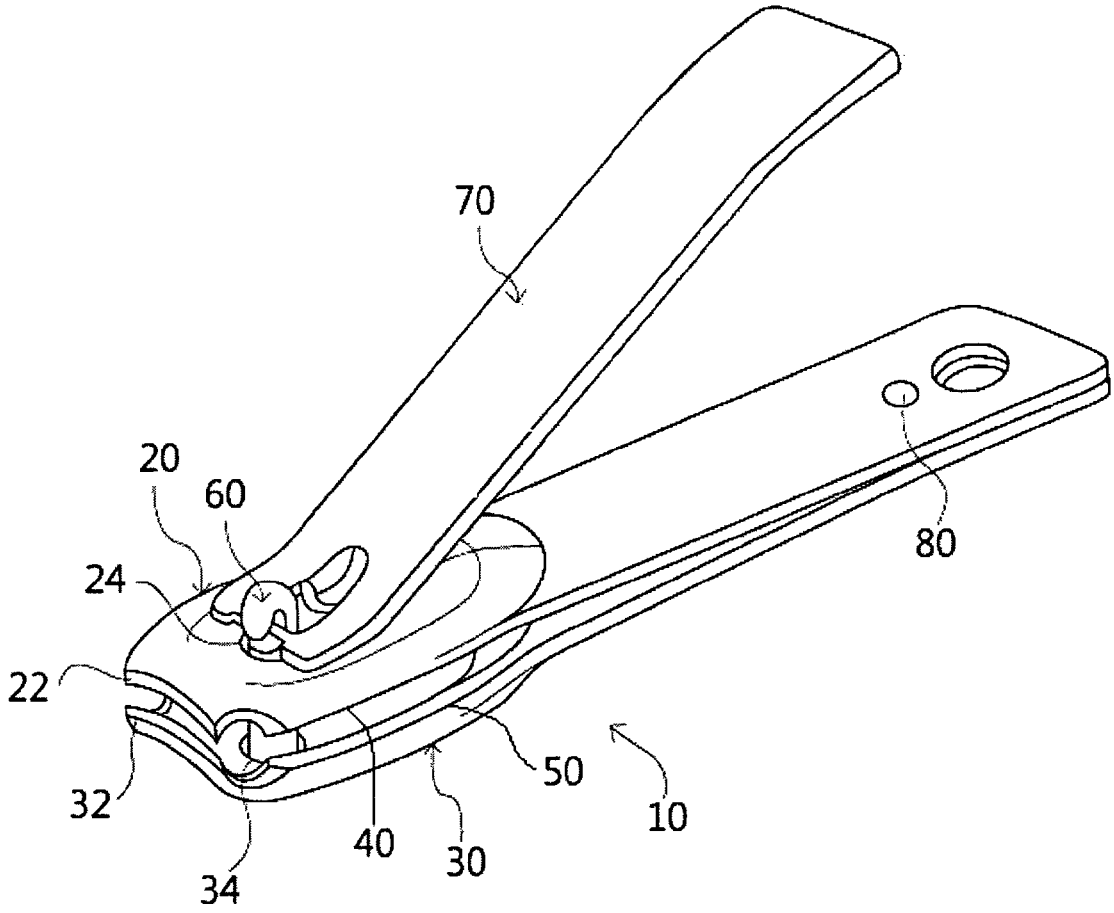

When the lever 70 of the nail clipper 10 in the state of FIG. 3A is pressed as shown in FIG. 3B to cut the nail, the rims 40, 50 of the upper and lower concave parts 26, 36 intercept the scattering nails, and the inner space formed by the concave parts 26, 36 plays the role of a collecting container to temporarily store the cut nails.

The lever 70 is joined by the hook holder 72, which is combined with the hook 62 in the supporting shaft 60.

A reference numeral 74 in the drawing indicates a fulcrum adjacent to the hook holder 72 on the lever 70, and No. 42 indicates the projections formed on the convex part 28 of the upper blade member 20, the purpose of which is to set the fulcrum at its position, but it is not an essential part.

The rims 40, 50 of the concave parts 26, 36 formed on the upper blade member 20 and the lower blade member 30, illustrated in FIG. 1 and FIG. 3A, are on the plane of the same height as that of the elastic parts of the upper blade member 20 and the lower blade member 30.

However, a little transformation is also possible where the rims 40, 50 of the concave parts 26, 36 are extended and some of the rims are overlapped, or the contact of the rims 40, 50 of the concave parts 26, 36 is leaned toward the top or the bottom.

In the above example, the upper blade member 20 and the lower blade member 30 are joined at one side by spot welding, but this is not the only method of the joint. The riveting, which is a common technique, may be used, or the upper blade member 20 and the lower blade member 30 may be consolidated and bent.

In addition, metal or high-strength plastic may be used for the lever 70 and the supporting shaft 60.

The upper blade member 20 and the lower blade member 30 are formed by press working, and the concave parts 26, 36 formed in cold plastic working by press.

Concerning the material for the upper blade member 20 and the lower blade member 30, stainless steel or carbon steel, which can maintain the minimum hardness at HRc 50 by heat treatment, can be used.

Because the concave parts 26, 36 that have a soft curved surface form convex parts 28, 38 like a dome shape when viewed from the outside, when the supporting shaft 60 is pulled, the stress on the upper blade member 20 is evenly distributed to all directions. The great improvement of structural strength resulting from this generates a much higher durability against stress than a plate with perpendicular sides. As a result, the nail clipper of the present invention has excellent durability against the pressing by the lever 70 on the upper blade member 20.

Due to this advantage, this nail clipper can greatly decrease the thickness of the metal plate over that of existing nail clippers result in an economic production, and the fiat elastic parts 44, 54 with a decreased thickness become softer.

According to the present invention described above, the level 70 is pulled up as in FIG. 3A with the lever laid over the upper blade member 20, as in FIG. 1, to prepare for nail clipping. Next, when the lever 70 is pressed down, the upper and lower blade members 20, 30 move by the leverage of the supporting shaft 60 and the fulcrum 74 as shown in FIG. 3B. The cutting blades 22, 32 are engaged to cut the nail. At this time, the rims of the concave parts 26, 36 are closed to prevent the scattering of cut nails, which are collected in the concave parts 26, 36.

As described above, one feature of the present invention is that the upper and lower rims 40, 50 maintain a close gap without contacting each other when the upper and lower cutting blades 22, 32 are engaged and cut the nail.

Another feature of this invention is the prevention of nail scattering by varying the height of the contact between upper and lower cutting blades 22, 32 and the height of closing of rims 40, 50 of the concave parts 26, 36 of the upper and lower blade members 20, 30.

In other words, as shown in FIG. 4, the central height h2 of the closing between the rims 40, 50 of the upper and lower blade members 20, 30 is higher than the height h1 of the meeting of the upper and lower cutting blades 22, 32.

In the case of the nail clipper 10 in FIG. 4, the height h1 of the contact between the upper and lower cutting blades 22,32 is lower than the height h2 of the rim 50, via a concave transition 50*a*, of the concave part 36 of the lower blade member 30 so that the cut nail is likely to scatter to the concave part 36 of the lower blade member 30 to prevent the scattering of nails in a more stable condition.

As described above, the cut nails cannot escape even if there is a small gap between the rims 40, 50 of the concave parts 26, 36 because the height of the contact between the cutting blades 22, 32 of the upper and lower blade members 20, 30 is different from the central height of the closing between the rims 40, 50 of the concave parts 26, 36.

Figure 5:
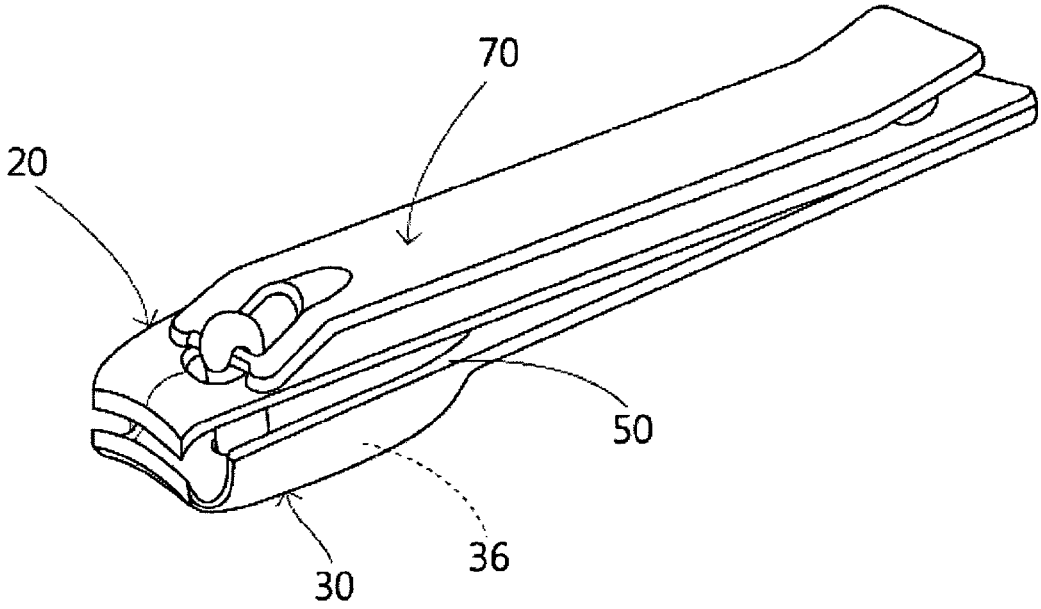
FIG. 5 is a perspective view illustrating a nail clipper where a concave part of a spoon shape is formed only on a lower blade member according to a modified example embodiment of FIG. 1.

FIG. 5 illustrates the forming of concave part 36 on the lower blade member 30 among the upper and lower blade members 20, 30 comprising the nail clipper.

When the concave part 36 is formed only on the lower blade member 30 as mentioned above, the rim 50 of the concave part 36 approaches the bottom surface of the flat upper blade member 20, and the cut nails are scattered to the concave part 36 of the lower blade member 30. As a result, the scattering of nails is prevented and the cut nails are collected in the concave part 36.

Figure 6:
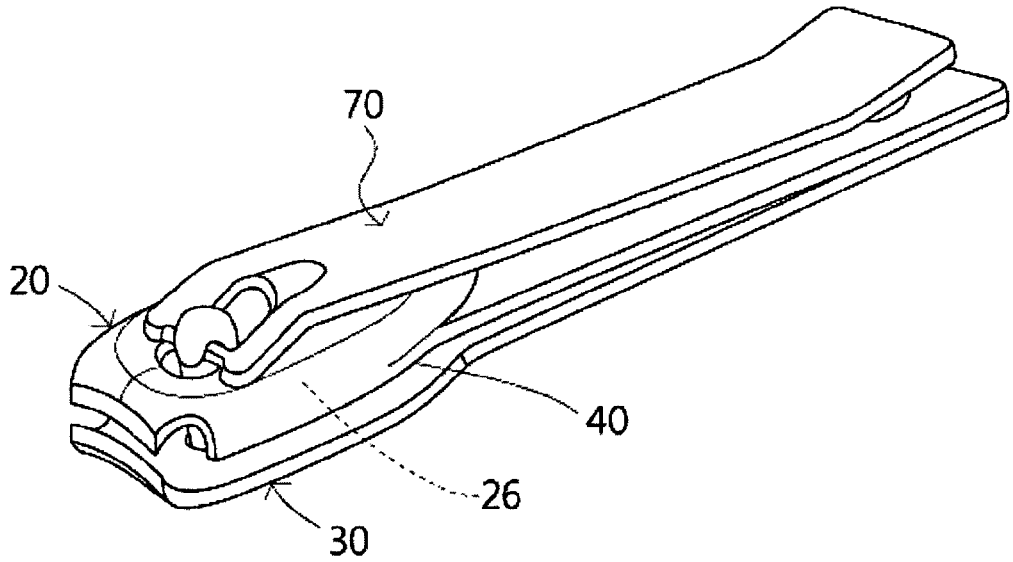
FIG. 6 is a perspective view illustrating a nail clipper where a concave part of a spoon shape is formed only on an upper blade member according to a modified embodiment of FIG. 1.

FIG. 6 illustrates the forming of concave part 26 on the upper blade member 20 among the upper and lower blade members 20, 30 comprising the nail clipper.

When the concave part 26 is formed only on the upper blade member 20 as mentioned above, the rim 40 of the concave part 26 approaches the top surface of the flat lower blade member 30, and the cut nails are scattered to the concave part 26 of the upper blade member 20. As a result, the scattering of nails is prevented and the cut nails are temporarily collected on the top surface of the lower blade member 30 before they are discarded to the floor.

The shape of the cutting blades 22, 32 in FIG. 1 to FIG. 6 illustrates the case where the cut nail is of a shape that has a convex curve.

Figure 7:
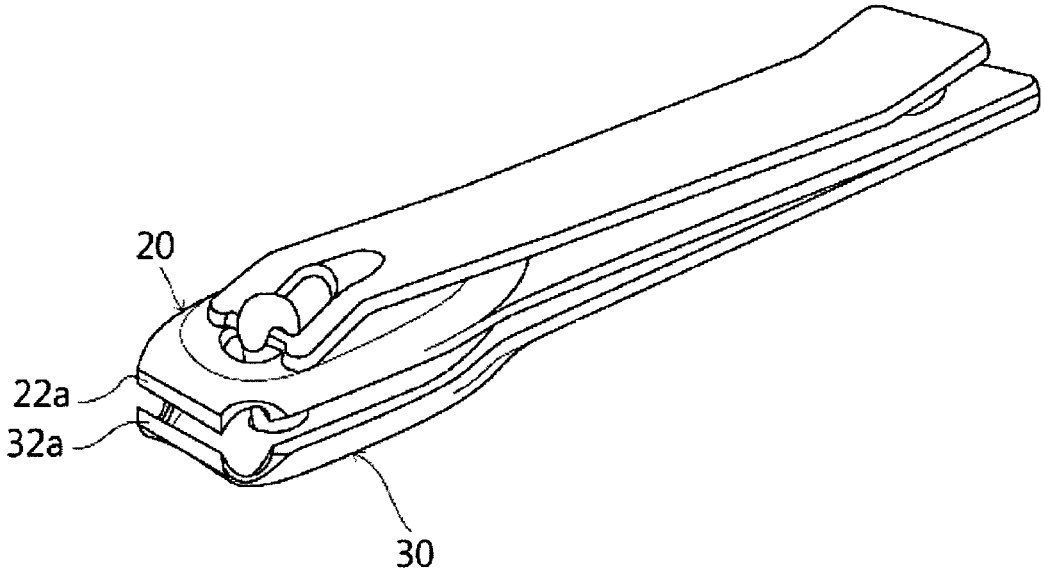
FIG. 7 to FIG. 10 are views of nail clippers for showing cutting blades formed at one side of upper and lower blade members according to various modified example embodiments of the present invention.

FIG. 7 illustrates a nail cutter where the cutting blades 22*a*, 32*a* are of a straight shape, in which case the nails are cut in a straight line.

Figure 8:
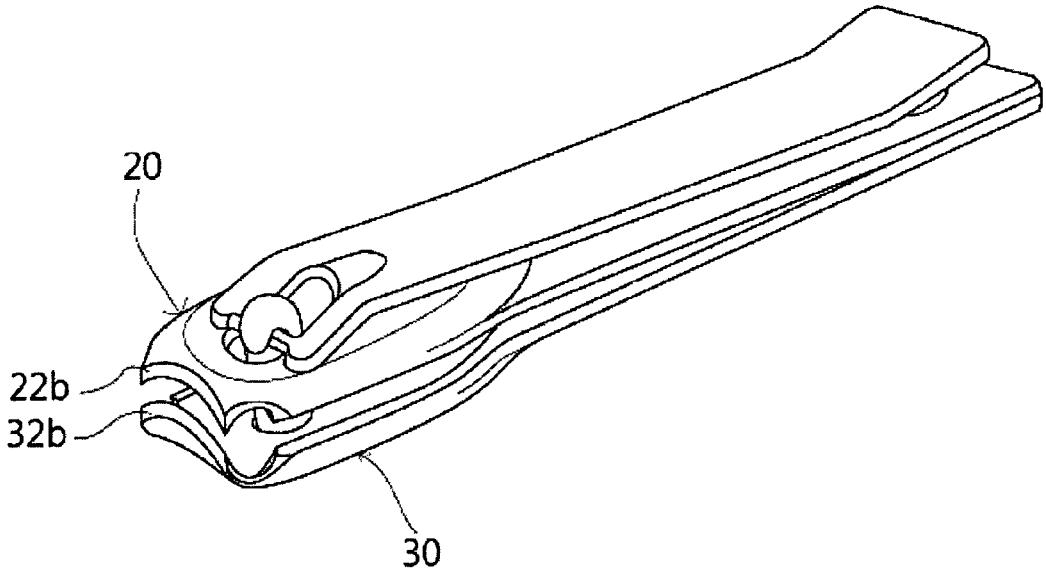

FIG. 8 illustrates a nail clipper where the cutting blades 22*b*, 32*b* are of an arch shape that corresponds to the sectional view of the nail. Because the shape of the cutting blades 22*b*, 32*b* is similar to the sectional view of the nail, it can cut nails in a more stable and soft manner than the typical nail clipper, which presses the center of nail and raises both sides of nail.

Figure 9:
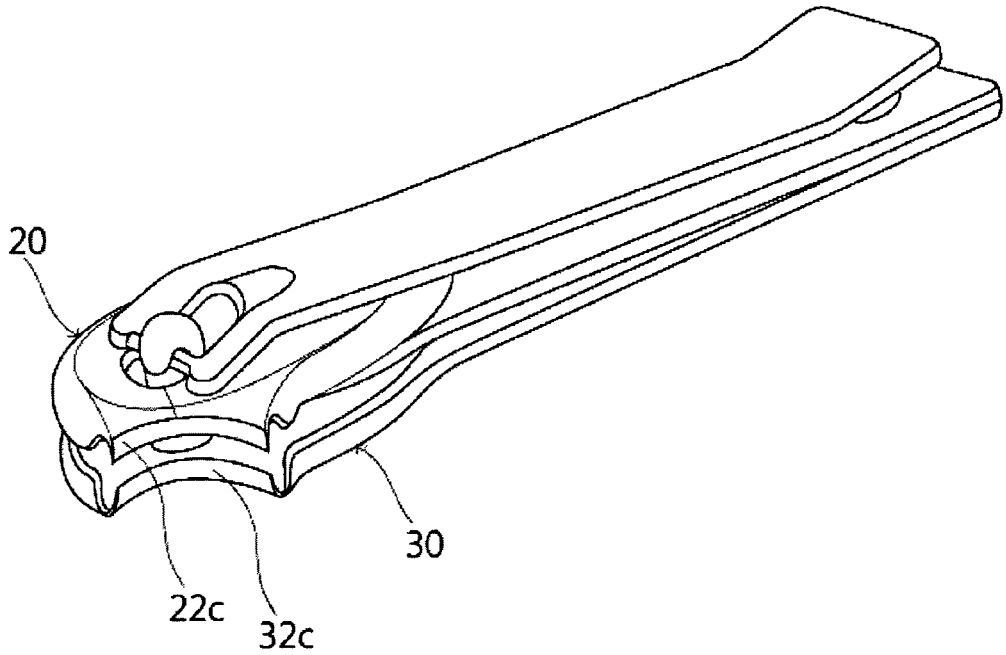
Figure 10:
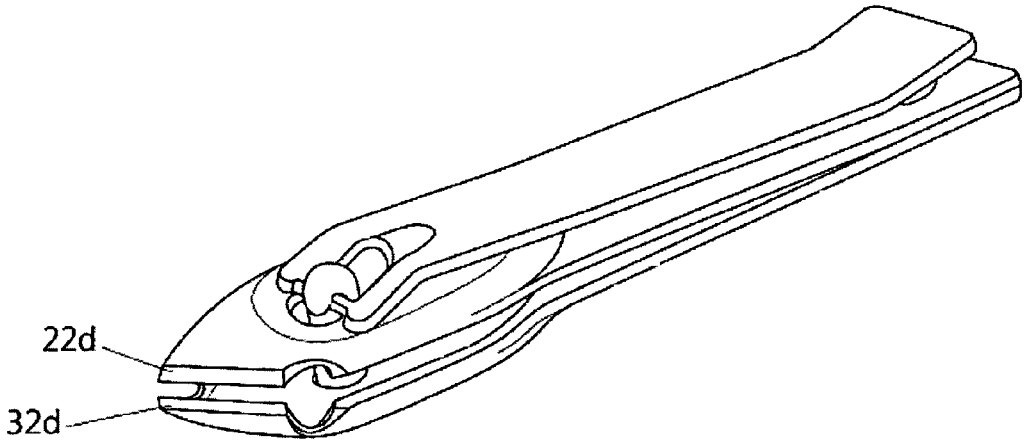

FIG. 9 illustrates a nail clipper where the shape of the cutting blades 22*c*, 32*c* is leaned toward one side, and FIG. 10 illustrates a nail clipper where the shape of the cutting blades 22*d*, 32*d* is leaned toward one side and pointed. As described above, the nail clipper of this invention may have various shapes. As described above, instead of extending both sides with upper and lower blade members and forming a scatter prevention wall by a separate perpendicular bending, a nail clipper of this invention is to provide upper and lower concave parts which are closed when the nail is cut to intercept the scattering of nails and store them temporarily, playing the role of a nail collecting container.

The present invention may be simply and easily manufactured because a concave part formed in a soft curved surface can be more naturally formed than a perpendicular bending in cold plastic working by pressing process.

From the mechanical point of view, this concave part forms a dome convex shape when viewed from the outside, so that the lever can evenly distribute the stress on the upper blade member to all directions. As a result, this has much better durability against stress than the scatter prevention wall of which both sides are perpendicularly bent. Further, the present invention may reduce manufacturing cost by decreasing the thickness of the material.

The invention claimed is:

1. A nail clipper, comprising:

upper and lower blade members, wherein each blade member has a cutting blade, a support shaft hole, a concave part in a spoon shape that is longer than it is deep, and an elastic part, wherein the elastic parts each extend from one end of the spoon-shaped concave parts and are joined together at a distance from the spoon-shaped concave parts such that the spoon-shaped concave parts oppose each other, wherein the cutting blades oppose each other and each cutting blade is at a free end of its spoon-shaped concave part opposite said one end, wherein the support shaft holes are in the spoon-shaped concave parts of the blade members adjacent to the cutting blades;

and a lever located above the upper blade member and connected with the upper and lower blade members via a supporting shaft.

2. The nail clipper as claimed in claim 1, wherein the cutting blades formed on the upper and lower blade members are formed in one of an inwardly curved shape and straight shape so that a nail will be cut in a convex curve or straight line, and are further formed in an arc shape in accordance with the sectional shape of the nail, in a shape slanted to one side, or in a shape that is slanted to one side and pointed.

3. The nail clipper as claimed in claim 1, wherein rims of the spoon-shaped concave parts of the upper and lower blade members are on the same plane as their respective elastic parts.

4. The nail clipper as claimed in claim 1, wherein the rims of the spoon-shaped concave parts of the upper and lower blade members have less deflection in a direction orthogonal to the plane of their respective elastic parts in the lengthwise direction of their respective elastic parts.

5. The nail clipper as claimed in claim 1, wherein a line of contact between the cutting blades of the upper and lower blade members is not in the same plane as the rims of the spoon-shaped concave parts.

6. A nail clipper, comprising:

upper and lower blade members, wherein each blade member has a cutting blade, a support shaft hole and an elastic part and at least one of the blade member has a spoon-shaped concave part that is longer than it is deep, wherein the elastic parts are joined together at a distance from the spoon-shaped concave part at one end of the upper and lower blade members, wherein the cutting blades oppose each other at the other end opposite the one end of the upper and lower blade members and adjacent to the spoon-shaped concave part, wherein one of the support shaft holes is in the spoon-shaped concave part of the at least one of the blade members and adjacent to the cutting blade of one of the blade members; and a lever located above the upper blade member and connected with the upper and lower blade members via a supporting shaft.

7. The nail clipper as claimed in claim 6, wherein the cutting blades formed on the upper and lower blade members are formed in one of an inwardly curved shape and straight shape so that a nail will be cut in a convex curve or straight line, and are further formed in an arc shape in accordance with the sectional shape of the nail, in a shape slanted to one side, or in a shape that is slanted to one side and pointed.

8. The nail clipper as claimed in claim 6, wherein a rim of the concave part is on the same plane as its respective elastic part.

9. The nail clipper as claimed in claim 6, wherein a rim of the concave part is off-set with respect to the plane of its respective elastic part in the lengthwise direction of the respective elastic part.

10. The nail clipper as claimed in claim 6, wherein the cutting blades are inwardly curved towards the elastic parts and are curved in a direction orthogonal to a plane between said elastic parts.

* * * * *